US007114975B2

(12) United States Patent
Liao et al.

(10) Patent No.: US 7,114,975 B2
(45) Date of Patent: Oct. 3, 2006

(54) CARD EDGE CONNECTOR WITH POSITION GUIDER

(75) Inventors: Yen-Jang Liao, Taoyuan Hsien (TW); Li-Sen Chen, Taoyuan Hsien (TW); Po-Jung Chen, Taoyuan Hsien (TW); Wen-Tsung Hsiao, Taoyuan Hsien (TW)

(73) Assignee: Speed Tech. Corp., Taoyuan Hsien (TW)

( * ) Notice: Subject to any disclaimer, the term of this patent is extended or adjusted under 35 U.S.C. 154(b) by 0 days.

(21) Appl. No.: 11/078,448

(22) Filed: Mar. 14, 2005

(65) Prior Publication Data

US 2006/0105605 A1 May 18, 2006

(30) Foreign Application Priority Data

Nov. 18, 2004 (TW) ..... 93218518 U

(51) Int. Cl.
*H01R 13/62* (2006.01)

(52) U.S. Cl. ..... 439/326; 439/374

(58) Field of Classification Search ..... 439/325–328, 439/629–637, 376–378, 680, 341, 374
See application file for complete search history.

(56) References Cited

U.S. PATENT DOCUMENTS

| | | | | |
|---|---|---|---|---|
| 5,326,276 | A * | 7/1994 | Cheng | 439/326 |
| 5,769,668 | A * | 6/1998 | Tondreault | 439/633 |
| 5,803,761 | A * | 9/1998 | Mochizuki | 439/326 |
| 6,666,702 | B1 * | 12/2003 | Pickles | 439/328 |
| 6,848,927 | B1 * | 2/2005 | Shirai | 439/326 |

* cited by examiner

*Primary Examiner*—Tho D. Ta
*Assistant Examiner*—Edwin A. Leon
(74) *Attorney, Agent, or Firm*—Lowe Hauntman & Berner

(57) ABSTRACT

A card edge connector includes a connection part and a position guider. The connection part includes a plurality of terminals disposed in parallel to electrically connect to contacts of a daughter board. The position guider disposed inside the connection part includes a guiding structure formed at two opposing lateral sides of the position guider. The guiding structure includes two slant surfaces extending respectively away from the left and right sides of the position guider. The slant surfaces are used to align the daughter board into a desired position to reduce a misalignment shift between the terminals of the connection part and the contacts of the daughter board.

4 Claims, 8 Drawing Sheets

CARD EDGE CONNECTOR WITH POSITION GUIDER

RELATED APPLICATIONS

The present application is based on, and claims priority from, Taiwan Application Serial Number 93218518, filed on Nov. 18, 2004, the disclosure of which is hereby incorporated by reference herein in its entirety.

BACKGROUND OF THE INVENTION

1. Field of Invention

The invention relates to a card edge connector and, in particular to a card edge connector with a position guider. The card edge connector can be used on a mother board of an electronic device for electrically connecting with a daughter board.

2. Related Art

The conventional card edge connector is normally comprised of a connection part, at least one position guider, and a fixing device. The connection part is provided with several terminals for electrical contacts with the contacts on the inserted daughter board. The position guider prevents incorrect insertion of the daughter board. The fixing device fixes the card edge connector on the circuit board.

In light of technological advances and environmental protection, all devices are made smaller. Therefore, the card edge connector and daughter boards have to be reduced in size too. The gaps between the terminals inside the card edge connector and the gaps between the contacts on the daughter board have to be reduced too.

Take a conventional card edge connector and a daughter board as an example. The width of each terminal inside the card edge connector is about 0.2 mm. The terminals are disposed at a pitch of 0.5 mm. Thus, the gap between each two adjacent terminals is 0.3 mm. Normally, the allowed error for a position guider is ±0.1 mm. The width of each connecting point on the daughter board is 0.33 mm. If they are disposed at the same pitch of 0.5 mm, the gap between each two adjacent contacts is 0.27 mm.

As shown in FIGS. 1A and 1B, the ideal matching between a card edge connector and a daughter board happens when there is no misalignment shift. The middle line of the crack 420 on the daughter board aligns with the middle of the position guider 200 of the card edge connector. Therefore, the middle line of the terminal 310 can align with the middle line of the connecting point 410 on the daughter board. Each terminal 310 inside the connection part 300 thus aligns well with each connecting point 410 on the daughter board 400, forming a good electrical connection.

As shown in FIGS. 1C and 1D, even though each of the card edge connector and the daughter board are satisfactory in measures, accumulated tolerance may result in mismatching or difficulty in practical uses. For example, suppose the left side of the position guider 200 of the card edge connector has an error of −0.1 mm and the left width of the crack 420 has an error of +0.05 mm. If the left side of the position guider 200 aligns with the left side of the daughter board crack 420 (their middle lines misalign with each other), then the misalignment shift between them is 0.15 mm when the daughter board 400 is inserted. The middle line of the terminal 310 misaligns with the middle line of the connecting point 410 by 0.15 mm. Therefore, the terminal 310 misaligns with the connecting point 410, contacting with each other by a tiny area. This will result in unstable electrical connections. Moreover, there is a tolerance between two adjacent contacts 410 on the daughter board. When accumulated tolerance happens, the accumulated misalignments of the contacts 410 and terminals 310 far from the base line will be big. This may eventually result in no conduction between a terminal 310 and a connecting point 410 or a short circuit because one terminal 310 simultaneously overlaps with two contacts 410. This is more likely to happen when the terminals 310 and the contacts 410 have a fine pitch or high density.

In FIGS. 1C and 1D, the gap between the left side of the position guider 200 and the left side of the daughter board crack 420 is to ensure the positions and shapes of the position guider 200 and the daughter board crack 420. In practice, the left side of the position guider 200 and the left side of the daughter board crack 420 stick to the same plane with no gap.

Moreover, since there is a gap between the daughter board crack 420 and the position guider 200 of the card edge connector due to the tolerance, vibrations or any other external forces may result in relative horizontal shifts between them when the daughter board 400 is inserted into the connection part 300 of the card edge connector. Therefore, the terminals 310 and the contacts 410 have a misalignment shift that causes imperfect contacts or short circuits.

SUMMARY OF THE INVENTION

An objective of the invention is to provide a card edge connector, which guides the insertion position of a daughter board into the card edge connector. It can reduce the misalignment shift between the terminals of the card edge connector and the contacts of the daughter board, maintaining good electrical connections between the daughter board and an electronic device.

To achieve the above objective, the disclosed card edge connector includes at least a position guider and a connection part. The connection part is disposed on a lateral surface in the longitudinal direction of the card edge connector. The connection part contains several terminals disposed in parallel and a long opening for the insertion of a daughter board. When the daughter board is inserted into the card edge connector, the contacts on the daughter board are in electrical connections with the terminals of the card edge connector. The inserted edge of the daughter board has at least a crack and several contacts.

The position guider of the card edge connector is disposed inside the connection part to prevent the daughter board from incorrect insertion. Therefore, the shape, position and size of the position guider match with the crack of the daughter board. The position guider contains a guiding structure, which contains two slant surfaces formed at two opposing lateral sides of the position guider. The slant surfaces extend in the opposite directions from the position guider.

With the connection and guidance of the daughter board crack and the guiding structure in the position guider of the card edge connector, the middle line of the daughter board crack aligns with the middle line of the position guider. It reduces the influence of the accumulated tolerance on the daughter board and the connection part, and renders a good electrical connection.

The disclosed card edge connector is often used along with a fixing device. The fixing device fixes the daughter board position after insertion and the connection between the daughter board and the card edge connector. However, the disclosed card edge connector is not limited to a specific fixing device. To avoid confusions, the fixing device is not explicitly shown in the drawings of the specification.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE PREFERRED EMBODIMENT

The present invention will be apparent from the following detailed description, which proceeds with reference to the accompanying drawings, wherein the same references relate to the same elements.

Since a normal card edge connector is installed above a mother board for electrically connecting a daughter board and the mother board. Therefore, the "above" or "below" mentioned herein refers to the relative position of the card edge connector and the mother board. For example, we say the card edge connector is above the mother board.

Figure 1A:
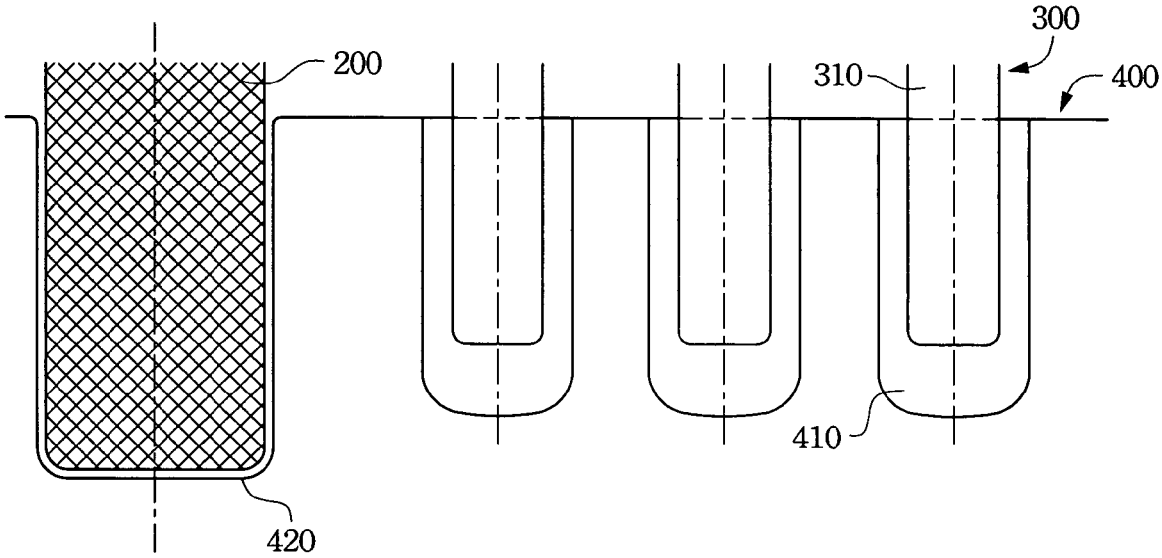
FIG. 1A (PRIOR ART)
FIG. 1A is a schematic view showing an optimal situation of conduction between a conventional card edge connector and a daughter board.
Figure 1B:
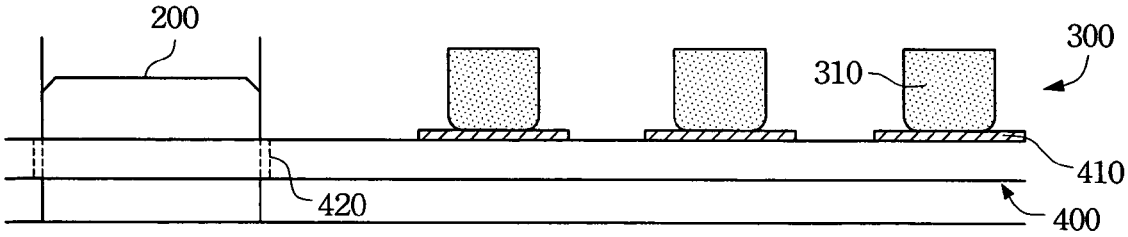
FIG. 1B (PRIOR ART)
FIG. 1B is a schematic side view of the insertion of the daughter board in FIG. 1A.
Figure 1C:
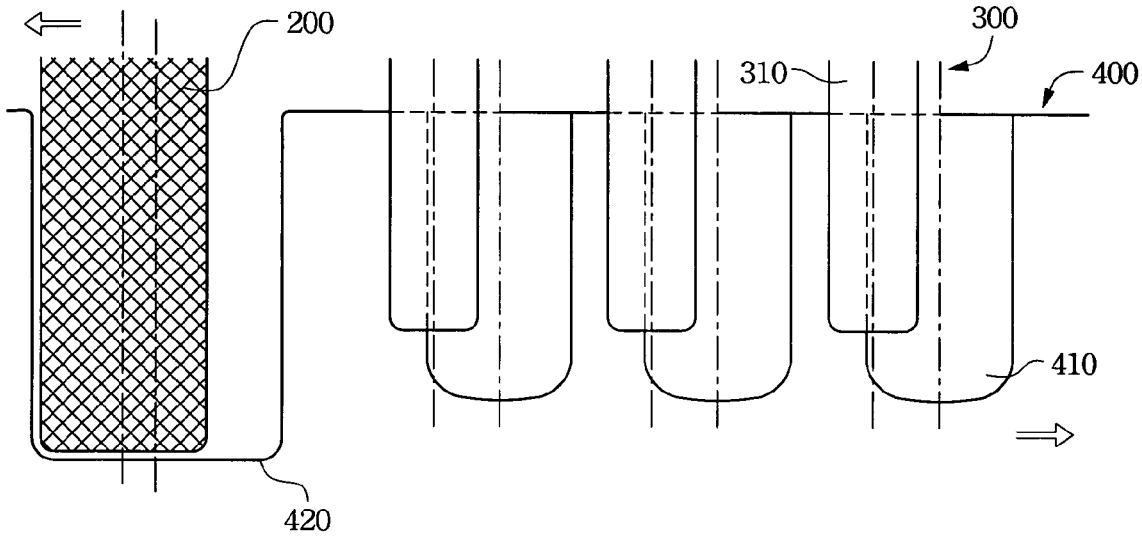
FIG. 1C (PRIOR ART)
FIG. 1C is a schematic view showing the misalignment shift between the card edge connector and the daughter board.
Figure 1D:
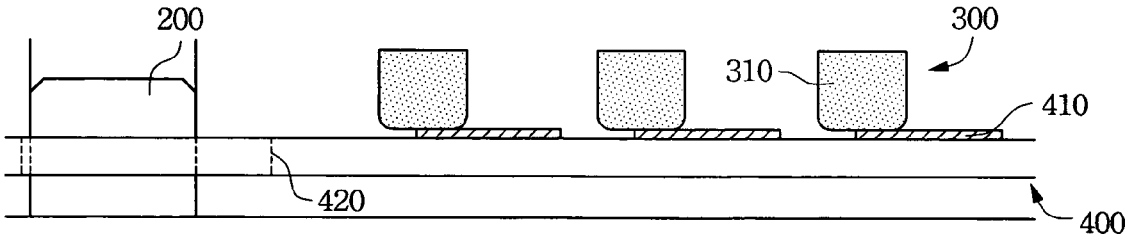
FIG. 1D (PRIOR ART)
FIG. 1D is a schematic side view of the insertion of the daughter board in FIG. 1C.
Figure 2:
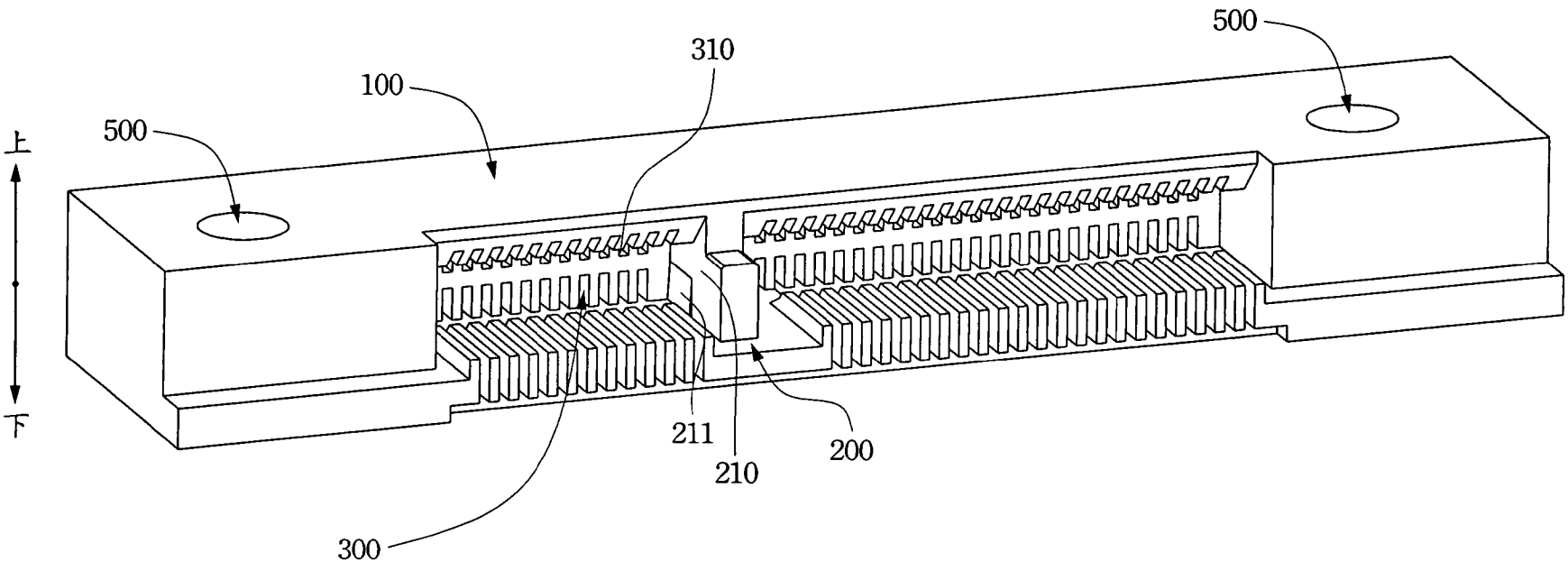
FIG. 2 is a three-dimensional view of the card edge connector according to a first embodiment of the invention.

As shown in FIG. 2, the card edge connector 100 according to a first embodiment includes a position guider 200 and a connection part 300.

The connection part 300 is disposed on one lateral surface along the longitudinal direction of the card edge connector 100 and is provided with several terminals 310 (see simultaneously FIGS. 4A to 4D) disposed in parallel. The connection part 300 has a long opening for the insertion of a daughter board 400 so that the contacts 410 on the daughter board 400 are in electrical connections with the terminals 310.

The position guider 200 is disposed inside the connection part 300 to prevent incorrect insertion of the daughter board into the card edge connector 100. Each of the left and right sides of the position guider 200 has a sidewall 210. The position guider 200 contains a guiding structure 211 formed by providing a slant surface on each of the left and right sides of the position guider 200. As shown in the drawing, the card edge connector 100 of this embodiment has only one position guider 200. However, some card edge connectors 100 may have two or three position guiders 200.

Figure 3A:
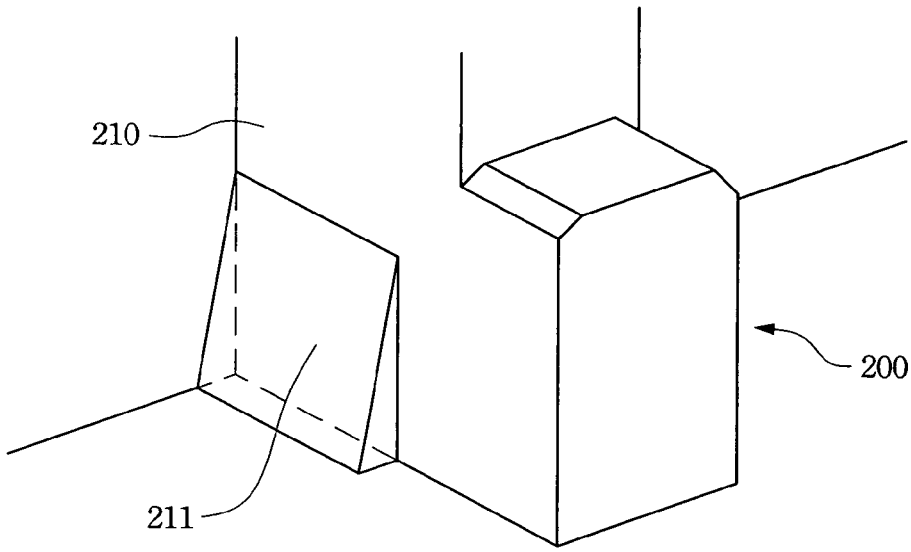
FIG. 3A is an exploded view of the position guider in FIG. 2.
Figure 3B:
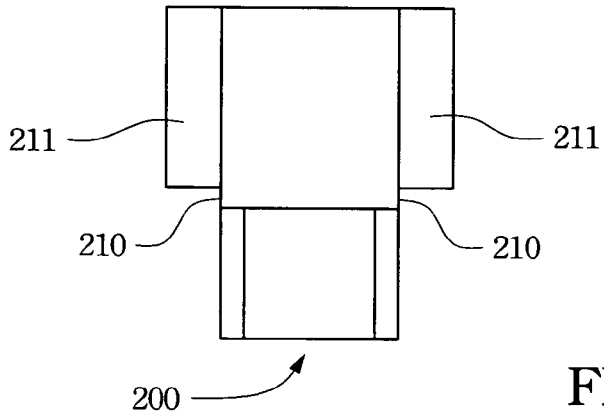
FIG. 3B is a schematic top view of FIG. 3A.
Figure 3C:
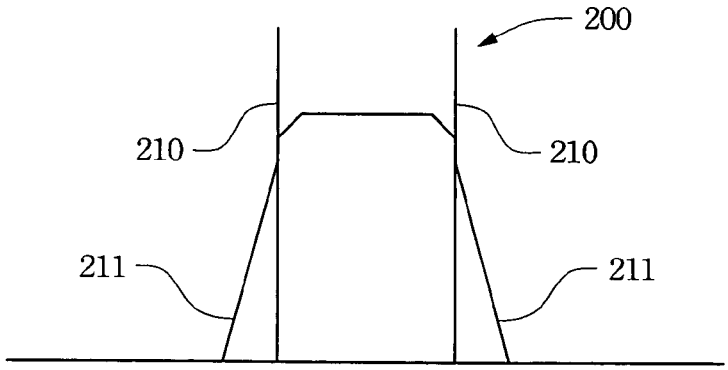
FIG. 3C is a schematic front view of FIG. 3A.

As illustrated in FIGS. 3A to 3C, the guiding structure 211 has two slant surfaces extending respectively downward and in opposite direction from the two sidewalls 210 of the position guider 200. According to the drawings, the two slant surfaces of the guiding structure 211 tilt in the directions away from the left and right sidewalls 210 of the position guider 200. The extension distance of the guiding structure 211 is roughly larger than the upper width limit allowed by the crack on the daughter board. This ensures that the two slant surfaces of the guiding structure 211 are in contact with the two sides of the daughter board crack. The guiding structure 211 thus achieves the desired effects.

The disclosed card edge connector 100 can further include a fixing device 500 (as in FIG. 2) disposed on the card edge connector 100 to fix it on the mother board.

Figure 4A:
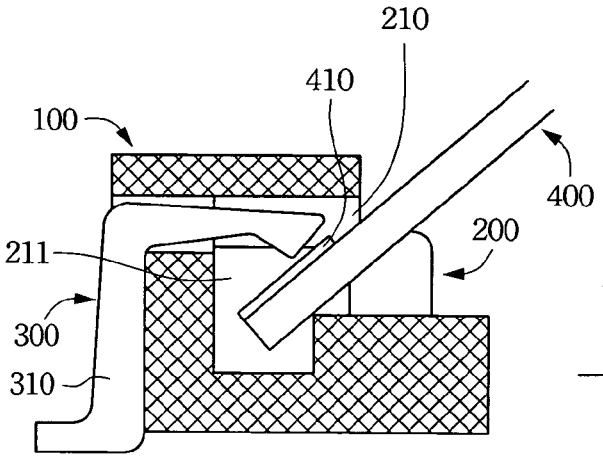
FIG. 4A is a schematic view of the daughter board inserted at an angle into the disclosed card edge connector.
Figure 4B:
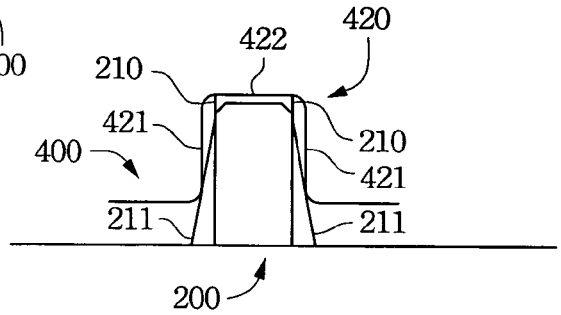
FIG. 4B is a schematic front view of the position guider in FIG. 2.

As shown in FIGS. 4A and 4B, the edge of the daughter board 400 to be inserted into the connection part 300 of the card edge connector 100 contains at least a crack 420 and several contacts 410. In this embodiment, the daughter board crack 420 is formed from the left and right sides 421 and a bottom edge 422 that matches with the position guider 200 of the connection part 300 of the card edge connector 100. The daughter board crack 420 and the position guider 200 of the card edge connector can have other matching shapes. To avoid confusions in the specification, this embodiment only shows the most common example.

Figure 4C:
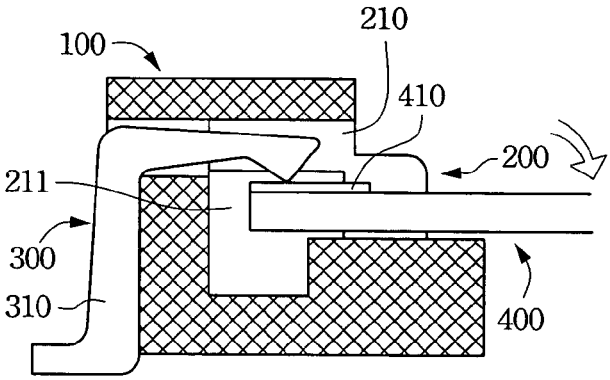
FIG. 4C is a schematic view of the back of the contacts on the daughter board.
Figure 4D:
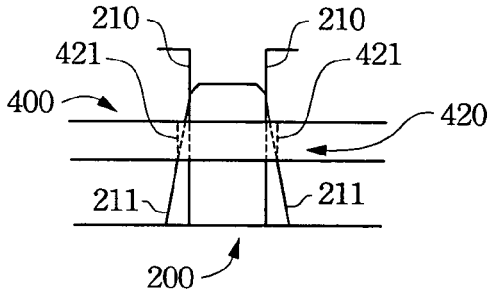
FIG. 4D is a schematic front view of the position guider in FIG. 4C.

As shown in FIGS. 4C and 4D, the daughter board 400 is inserted at an angle into the connection part 300 of the card edge connector 100. Afterward, the daughter board 400 is pivoted to be roughly parallel with the underneath mother board (not shown), at the same time fixing the daughter board 400. During the assembly, the extension distance of the guiding structure 211 is slightly larger than the allowed upper limit of the width of the daughter board crack. Therefore, the two sides 421 of the daughter board crack 420 touch at least one slant surface of the guiding structure 211 of the position guider 200. The slant surface of the guiding structure 211 then exerts a force with a component in the horizontal direction to guide the crack 420 of the daughter board 400 into the connection part 300. The middle line of the crack 420 overlaps with the middle line of the position guider 200. Since the daughter board crack 420 is guided by the guiding structure 211 of the card edge connector 100 into the correct position and the extension distance of the guiding structure 211 is slightly larger than the allowed upper limit of the width of the daughter board crack 420, the two sides 421 of the daughter board crack 420 are simultaneously in contact with the two slant surfaces of the guiding structure 211. That is, there is no gap between the daughter board crack 420 and the position guider 200 of the card edge connector 100. Based upon the aforementioned reasons, there is unlikely to have a misalignment shift between the daughter board 400 and the card edge connector 100 when vibrations happen.

Any person skilled in the art can make various kinds of modifications without departing from the spirit of the invention. For example, the shapes, colors, textures, and numbers of all components are not limited to the card edge connector shown in the drawings, as long as they possess the desired functions described herein.

Figure 5A:
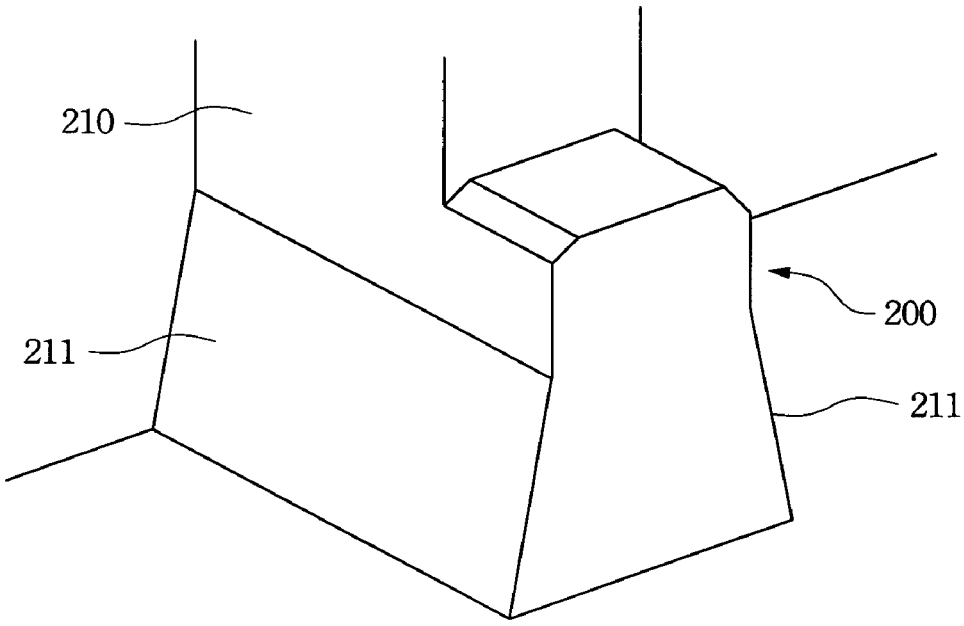
FIG. 5A is an exploded view of part of the position guider in another embodiment of the invention.
Figure 5B:
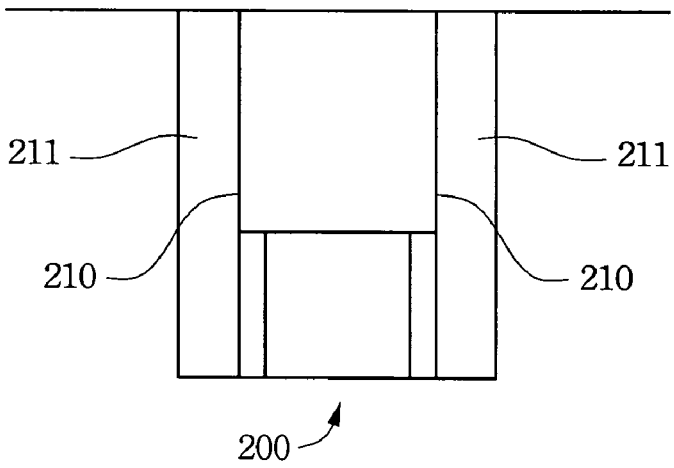
FIG. 5B is a schematic top view of FIG. 5A.

As shown in FIGS. 3A and 3B, the slant surfaces of the guiding structure of the card edge connector in the first embodiment extend from the middle section of the position guider. However, in FIGS. 5A and 5B, the slant surfaces extend from the front of the position guider 200 backward, still achieving the desired effects.

Figure 6A:
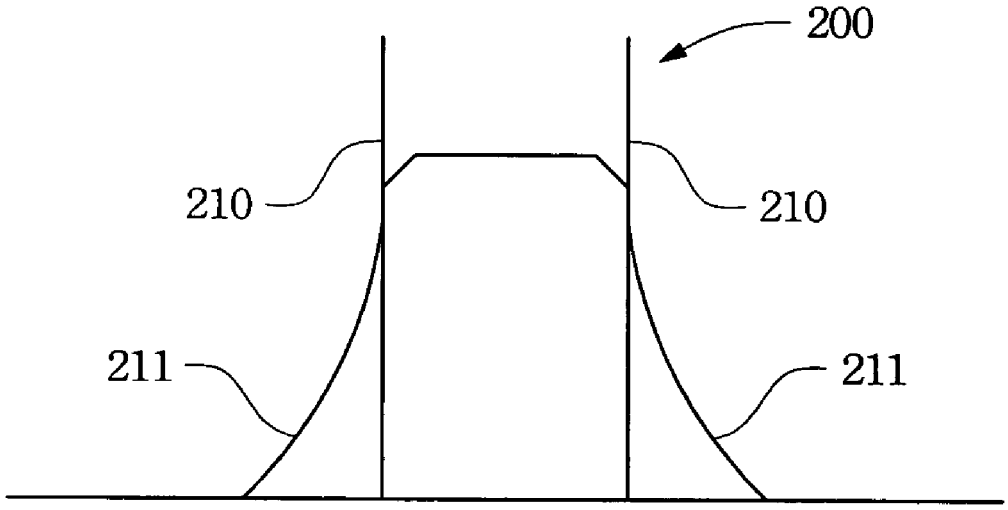
FIG. 6A is a schematic front view of the guiding structure with a concave surface in another embodiment of the disclosed card edge connector.
Figure 6B:
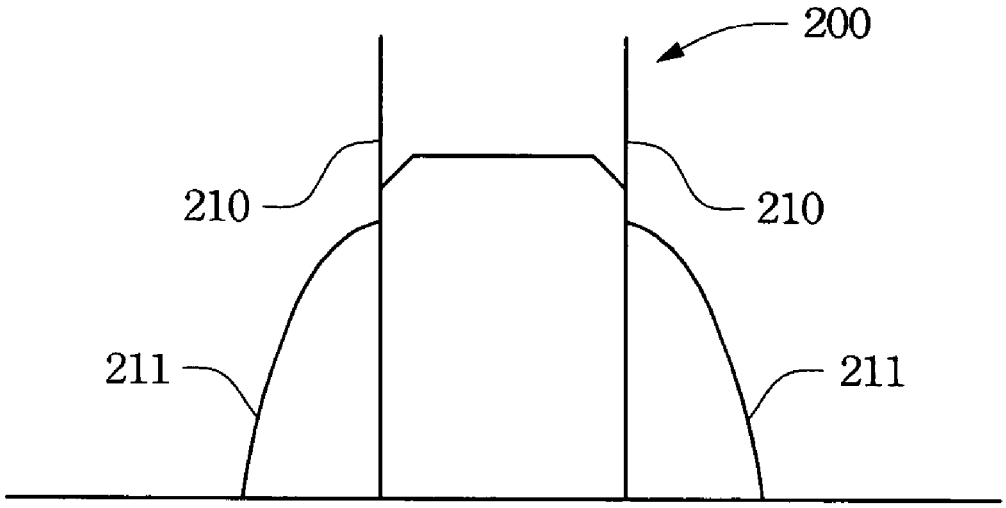
FIG. 6B is a schematic front view of the guiding structure with a convex surface in yet another embodiment of the disclosed card edge connector.

As shown in all the previous plots, the slant surfaces of the guiding structure in the disclosed embodiments are flat surfaces. As long as being able to touch and correct the relative position between the daughter board crack and the position guider of the card edge connector, any surface with the function of correcting the misalignment shift belongs to the invention. That is, the slant surface may be a convex or concave surface with a curvature, as shown in FIGS. 6A and 6B, respectively.

Figure 7A:
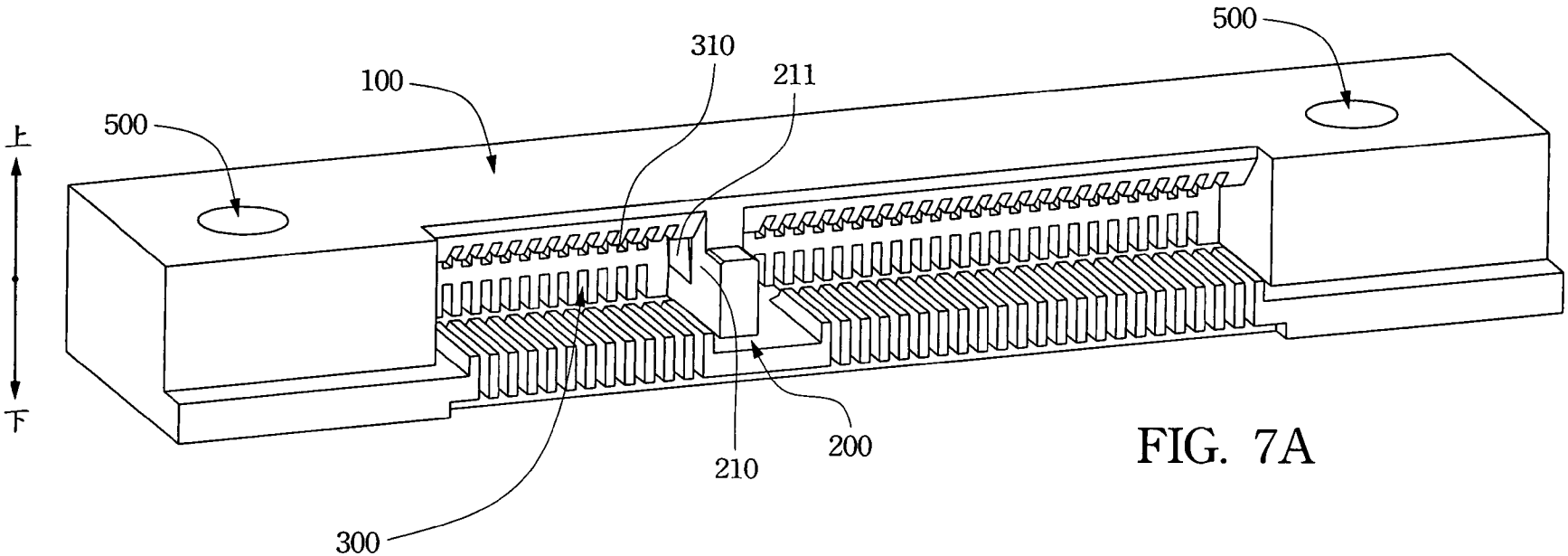
FIG. 7A is a three-dimensional view of a second embodiment of the invention, where the guiding structure is disposed above the card edge connector.
Figure 7B:
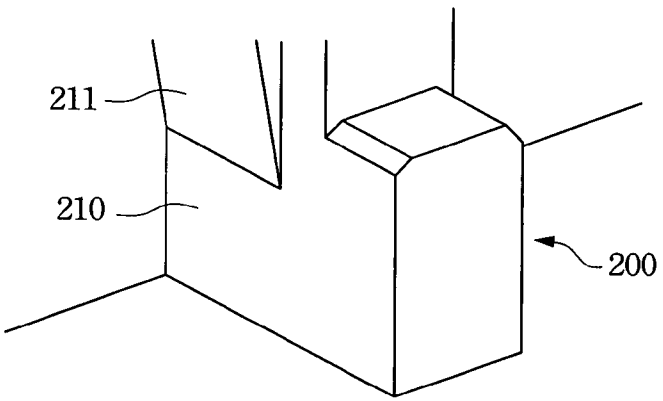
FIG. 7B is an exploded view of part of the position guider in FIG. 7A.

Moreover, FIGS. 7A and 7B show a second embodiment, in which the guiding structure 211 is disposed above the position guider 200. Likewise, the slant surfaces are used to correct the relative positions of the daughter board and the card edge connector.

The disclosed card edge connector uses the guiding structure on its position guider to reduce the misalignment shift between the terminals of the connection part and the contacts on the daughter board. It can be applied to conventional daughter boards with cracks and contacts. Such applications should be included in the claims of the invention.

From the above-mentioned embodiments, we know that the invention has the following advantages:

1. The slant surfaces of the guiding structure correct the relative positions of the daughter board and the card edge connector, reducing the misalignment shift between the terminals of the connection part in the card edge connector and the contacts of the daughter board.

2. The slant surfaces of the guiding structure of the card edge connector are in contact with the two sides of the daughter board crack. Therefore, the daughter board is unlikely to shift within the card edge connector due to vibrations.

3. The invention only uses the guiding structure on the position guider to reduce possible misalignment shift between the terminals of the connection part and the contacts of the daughter board. It can be used to all kinds of daughter boards with cracks and contacts. Therefore, the invention has wide applications.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A card edge connector on a circuit board of an electronic device for the insertion of one edge of a daughter board, wherein the edge has at least a crack and a plurality of contacts, said card edge connector comprising:

a connection part disposed on a side surface at the card edge connector in the longitudinal direction, containing a plurality of terminals in parallel, and formed with a long opening for the insertion of the daughter board to enable the contacts of the daughter board to be in electrical connections with the terminals; and a position guider disposed inside the connection part to prevent the daughter board from inserting incorrectly into the card edge connector and containing a guiding structure, wherein the guiding structure includes two slant surfaces extending in opposite directions from the left and right sides of the position guider, a largest width of the position guider is slightly larger than an allowed upper limit of the width of the daughter board crack so that the two slant surfaces are simultaneously in contact with inner walls of the daughter board crack to guide the daughter board to a desired position.

2. The card edge connector of claim 1, wherein said card edge connector further comprises a fixing device disposed on the card edge connector for fixing the card edge connector on the circuit board.

3. The card edge connector of claim 1, wherein each of the slant surfaces is a concave surface.

4. The card edge connector of claim 1, wherein each of the slant surfaces is a convex surface.

* * * * *